US005591915A

United States Patent [19]

Theurer et al.

[11] Patent Number: 5,591,915

[45] Date of Patent: Jan. 7, 1997

[54] SYSTEM FOR THE CONTINUOUS MEASUREMENT OF THE RESISTANCE OF A TRACK TO TRANSVERSE DISPLACEMENT

[75] Inventors: Josef Theurer, Vienna; Bernhard Lichtberger, Leonding, both of Austria

[73] Assignee: Franz Plasser Bahnbaumaschinen-Industriegesellschaft M.B.H., Vienna, Austria

[21] Appl. No.: 458,264

[22] Filed: Jun. 2, 1995

[30] Foreign Application Priority Data

Jun. 17, 1994 [AT] Austria ..... 1203/94

[51] Int. Cl.[6] ..... E01B 35/00; E01B 27/00

[52] U.S. Cl. ..... 73/646; 73/146; 104/2; 104/7.2; 104/10; 104/12

[58] Field of Search ..... 104/2, 7.1, 7.2, 104/7.3, 8, 9, 10, 12; 73/146, 587, 645, 646, 662

[56] References Cited

U.S. PATENT DOCUMENTS

| | | | |
|---|---|---|---|
| 3,643,583 | 2/1972 | Plasser et al. | 73/146 |
| 3,906,789 | 9/1975 | Bigmann | 73/146 |
| 4,643,101 | 2/1987 | Theurer | 104/7.2 |
| 5,127,333 | 7/1992 | Theurer | 104/2 |
| 5,257,579 | 11/1993 | Theurer | 104/2 |
| 5,419,259 | 5/1995 | Theurer et al. | 104/7.2 |

OTHER PUBLICATIONS

Gyula Sari, "The Influence of the Dynamic Track Stabilizer . . . " Transport International, No. 1, Jun. 1981, pp. 3–6.

*Primary Examiner*—Hezron E. Williams
*Assistant Examiner*—Rose M. Finley
*Attorney, Agent, or Firm*—Collard & Roe, P.C.

[57] ABSTRACT

A method of continuously measuring the resistance of a track to transverse displacement comprises the steps of continuously advancing a dynamic stabilizer along the track, applying a power to the dynamic stabilizer to impart oscillations to the track extending transversely to the track in a horizontal plane, and recording a datum corresponding to the applied power as a correlated measurement value of the transverse track displacement resistance (QVW).

9 Claims, 1 Drawing Sheet

SYSTEM FOR THE CONTINUOUS MEASUREMENT OF THE RESISTANCE OF A TRACK TO TRANSVERSE DISPLACEMENT

BACKGROUND OF THE INVENTION

1. Field of the Invention

The present invention relates to a method and a measuring apparatus for continuously measuring the resistance of a track to transverse displacement while the track is oscillated in a horizontal plane and in a transverse direction and to a dynamic track stabilizer incorporating such a method and apparatus.

2. Description of the Prior Art

U.S. Pat. No. 4,643,101 discloses a mobile track leveling, lining and tamping machine to which a dynamic track stabilizer is coupled. The track stabilizer may be a self-propelled machine which may be operated independently or in connection with other track working machines when uncoupled. As is known, dynamic track stabilization considerably improves the stability and particularly the resistance of the track to transverse displacement after tamping, which causes the ballast bed to become relatively loose. Dynamic track stabilization artificially simulates in a single operation what train traffic over a long period of time produces: settling and consolidation of the ballast to provide a firm support for the track at a desired position. This is achieved by frictionally gripping the rails of the track by rollers adjustably mounted on a track stabilization unit and imparting oscillations to the gripped track which extend in a horizontal plane in a transverse direction while at the same time applying a vertical load to the track, thus simulating the force a passing train applies to the track. The dynamic track stabilization "rubs" the track into the ballast, causing the ballast to be consolidated and the track to be settled at a desired level if the operation is controlled by a track level reference system. The result is not only a durable and uniformly elastic ballast bed but also an increased resistance to a transverse displacement of the track, which is a function of the friction between the track ties and the ballast.

The quality of the ballast bed consolidation may be deduced from the magnitude of the resistance of the track to transverse displacement (QVW), which determines the lateral stability of the track. The measurement of this lateral resistance has been made independently of the dynamic track stabilization or other track work. For example, an article by Gyula Sari, entitled "The Influence of the Dynamic Track Stabilizer on Track Geometry," in Transport International, No. 1, June 1981, pp. 3–6, describes such a measurement made at individual ties of a track. In this measurement operation, the rail fasteners are first removed at the tie where the measurement is made, the ballast next to one end of the tie is removed without disturbing the remaining ballast surrounding the tie, and a measuring device consisting of a hydraulic cylinder is attached to the tie end to displace the tie in a transverse direction by the application of a steadily increasing hydraulic pressure. Measurement of the displacement enables the lateral resistance to be determined. This measuring operation requires a substantial amount of work and also can be done only in spot checks.

Finally, U.S. Pat. No. 5,127,333 discloses a dynamic track stabilizer with a device for measuring the amplitudes of the horizontal oscillations, from which the resistance of the track to transverse displacement (QVW) may be deduced.

SUMMARY OF THE INVENTION

It is the primary object of this invention to provide a system for continuously measuring the resistance of a track to transverse displacement, in which the measuring results give a dependable indication of the lateral resistance without in any way changing with the track position.

According to one aspect of the invention, this and other objects are accomplished with a method comprising the steps of continuously advancing a vibrating means along the track while the vibrating means grips the track, applying a power to the vibrating means to impart oscillations to the track extending transversely to the track in a horizontal plane, power being defined as work done per time unit and work being defined as transfer of energy from one body to another, and recording a datum corresponding to the applied power as a correlated measurement value of the transverse track displacement resistance (QVW).

The power applied to the vibrating means to impart oscillations to the track, i.e. the energy transmitted to the track, is corelated with the lateral resistance opposing this power so that a datum corresponding to the applied power is corelated to the transverse track displacement resistance. If factors influencing the oscillation power such as the frequency of the oscillations, the amplitude of the oscillations and the static load on the track are kept constant, the transverse track displacement resistance (QVW) may be deduced directly from the power applied to the vibrating means. This method has the great economic advantage that a QVW-measurement may be effectuated simultaneously with the dynamic track stabilization. Thus, a documented indication of the lateral resistance of a track section is available at the end of a track leveling and/or lining operation and a finishing dynamic track stabilization, and this dependably indicates the durable stability of the track.

In a measuring apparatus for continuously measuring the resistance of a track to transverse displacement, which comprises a machine frame adapted to advance continuously along the track, a vibrating means mounted on the machine frame and including adjustable tools for selectively gripping the track rails for frictional engagement therewith, and a generator of oscillations connected to the vibrating means for imparting to the track gripped by the adjustable tools oscillations extending transversely to the track in a horizontal plane, the generator including a hydraulic power system comprising a hydraulic pump delivering an operating hydraulic pressure, the present invention provides a pressure indicator recording a datum corresponding to the hydraulic pressure power delivered to the vibrating means.

In yet another aspect of this invention, there is provided a dynamic track stabilizer for settling a track comprising two rails at a desired level and for continuously measuring the resistance of the track to transverse displacement, which comprises a machine frame adapted to advance continuously along the track on undercarriages supporting the machine frame on the track, a track stabilizing unit including adjustable tools for selectively gripping the track rails for frictional engagement and a generator of oscillations for imparting to the track gripped by the adjustable tools oscillations extending transversely to the track in a horizontal plane, the generator including a hydraulic pump delivering an operating hydraulic pressure, a vertically adjustable drive means connecting the track stabilizing unit to the machine frame, a track level reference system on the machine frame for establishing the desired track level, a pressure indicator recording a datum corresponding to the hydraulic pressure delivered by the hydraulic pump, and a recording device for recording the datum as a corelated measurement value of the transverse track displacement resistance.

BRIEF DESCRIPTION OF THE DRAWING

The above and other objects, advantages and features of the invention will become more apparent from the following detailed description of a now preferred embodiment thereof, taken in conjunction with the accompanying somewhat schematic drawing wherein.

DETAILED DESCRIPTION OF THE PREFERRED EMBODIMENT

Figures 1, 2, 3:
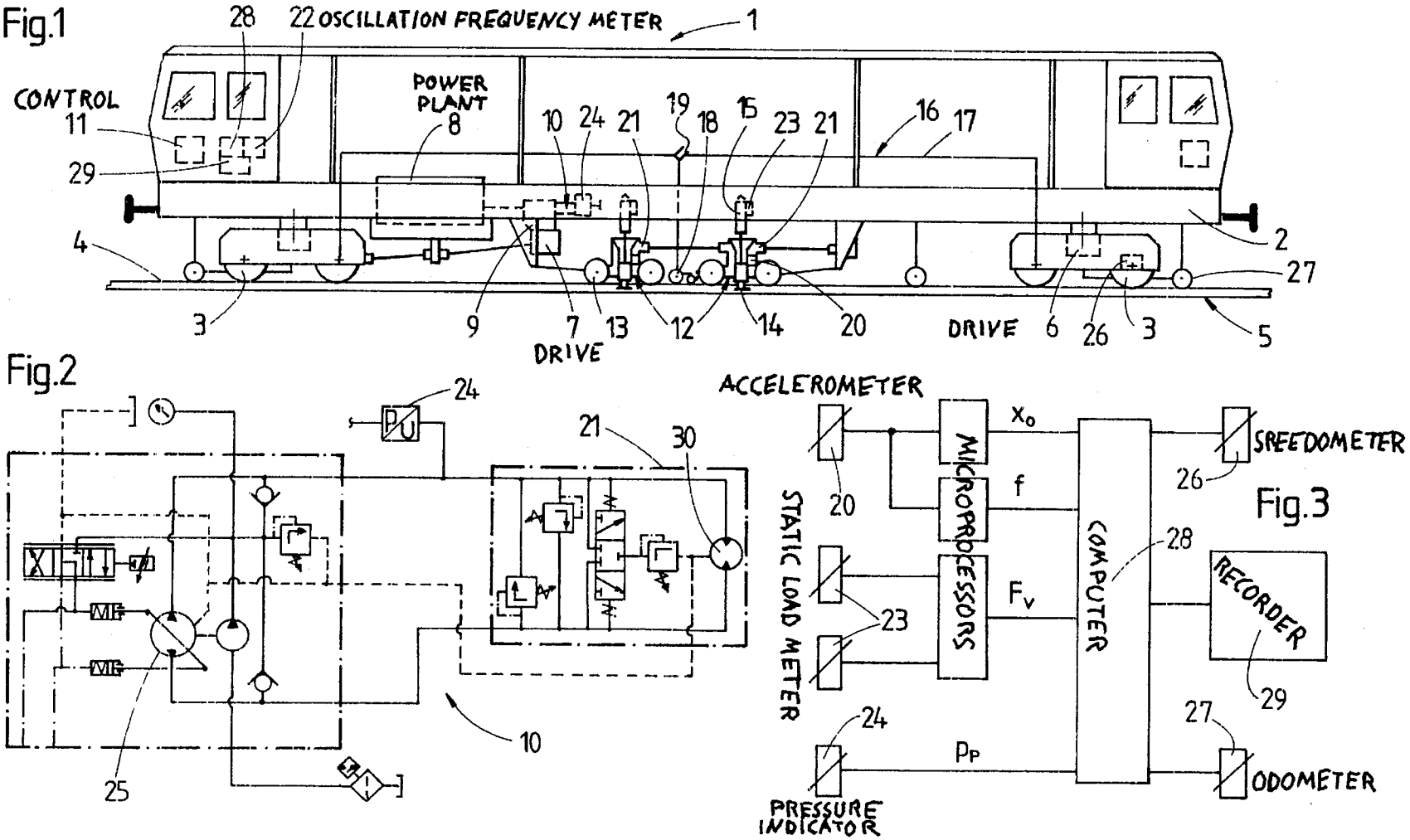
FIG. 1 is a side elevational view of a generally known dynamic track stabilization machine incorporating structures for measuring the resistance of the track to transverse displacement.
FIG. 2 is a circuit diagram showing the hydraulic system for applying power to the vibrating means.
FIG. 3 is a simplified circuit diagram illustrating various measuring devices for determining the resistance of the track to transverse displacement.

FIG. 1 illustrates machine 1 which is a dynamic track stabilizer for settling a track 5 comprising two rails 4 at a desired level and for continuously measuring the resistance of the track to transverse displacement. The machine is a standard railroad car and comprises an elongated machine frame 2 adapted to advance continuously along the track on undercarriages 3 supporting machine frame 2 on track 5. A drive 6 is associated with each undercarriage to advance the machine continuously, and a further hydrodynamic drive 7 is provided to drive the machine to and from an operating site. A central power plant 8 and a hydraulic system 10 with a hydraulic unit 9 provide power to all operating drives of machine 1. An operator's cab is mounted on machine frame 2 at each end thereof and houses operating and control devices 11 enabling an operator in the cab to drive machine 1 along the track and to operate twin track stabilizing units 12 arranged sequentially in the longitudinal direction of the track in the middle of machine frame 2 between undercarriages 3. This arrangement is more fully described in the above-mentioned U.S. patents whose disclosures are incorporated herein by way of reference to avoid redundancy. Each track stabilization unit has flanged wheels 13 and includes pivotally adjustable roller tools 14 for selectively gripping track rails 4 for frictional engagement. Flanged wheels 13 may be pressed against the gage sides of rails 4 by spreading devices so that each rail is gripped tightly between roller tools 14 and pairs of flanged wheels 13. A generator 21 of oscillations is connected to each unit 12 for imparting to track 5 gripped by the adjustable tools oscillations extending transversely to the track in a horizontal plane.

As shown in FIG. 2, each generator includes a hydraulic pump 25 delivering an operating hydraulic pressure, and a vertically adjustable hydraulic cylinder drive 15 links each track stabilizing unit 12 to machine frame 2 to apply a static vertical load to track 5. Furthermore, a track level reference system 16 is mounted on the machine frame for establishing the desired track level by controlling the hydraulic pressure in cylinders 15 and the oscillation generators which produces a settling of the track. The track level reference system includes a tensioned wire 17 above each rail 4 and a level sensor comprising roller 18 running on each rail between the two dynamic stabilization units 12 and carrying level sensor 19 engaging the associated tensioned wire.

According to the invention and as shown in FIGS. 2 and 3, a pressure indicator 24 is mounted in hydraulic system 10 between hydraulic pump 25 and oscillation generator 21 for indicating the power, i.e. the hydraulic pressure, operating the generator. In the illustrated embodiment, another measuring device 20, i.e. an acceleration measuring device, indicates the amplitude of the generated oscillations and still another measuring device 22 indicates the frequency of the generated oscillations. Furthermore, a pressure indicator 23 is connected to each hydraulic cylinder drive 15 for indicating the static load on the track. Additional measuring devices 26, 27 serve to indicate the forward speed of machine 1 during its continuous advance along the track and the length of the path traversed by the machine during the track stabilization operation. All the measuring devices and pressure indicators are connected to computer 28 and recording device 29 for recording the indicated data, including the datum corresponding to the hydraulic pressure delivered by hydraulic pump 25 to hydromotor 30 of oscillation generator 21 as a corelated measurement value of the transverse track displacement resistance.

FIG. 3 schematically illustrates how the measurement devices operate to record the transverse track displacement resistance. Measuring device 20 indicates the transverse acceleration a[$ms^2$]. By double integration, the datum corresponding to the amplitude $x_o$ of the oscillation is fed to computer 28. Frequency f of the oscillation is fed to the computer from measuring device 20. Static load $F_v$ is indicated for each rail by pressure gages 23 and the corresponding datum is also fed to computer 28. Pressure gage 24 feeds to the computer a datum corresponding to operating pressure $P_p$ applied to oscillation generator 21. Odometer 27 records the distance traveled by machine 1 from a predetermined point so that the recorded resistance of the track to transverse displacement may be accurately associated with predetermined track sections. Speedometer 26 makes it possible to take into account the effect of the forward speed of machine 1 on the lateral resistance of the track.

The following symbols are used to explain the theoretical basis for determining the resistance of the track to transverse displacement (QVW):

| | |
|---|---|
| $\mu$ | value of friction between ballast bed and tie |
| dt | time differential |
| dW | energy differential |
| f | oscillation frequency |
| $F_v$ | vertical static load on track |
| $k_o$ | coefficient |
| $k_v$ | coefficient |
| $k'_o$ | coefficient |
| $k'_v$ | coefficient |
| $n_p$ | rpm of hydromotor 30 for dynamic stabilization unit 12 |
| $P_{ab}$ | power output |
| $P_{DGS}$ | vibratory power of dynamic stabilization unit 12 |
| $P_g$ | vibratory power of track and ballast |
| $P_P$ | operating pressure applied to oscillation generator 21 |
| $P_r$ | friction power |
| $P_{rot}$ | rotational power component |
| $P_{zu}$ | power input |
| $Q_p$ | output of hydraulic pump 25 |
| QVW | resistance of track to transverse displacement |
| $QVW_{100}$ | standardized lateral resistance (load 100 kN) |
| t | time |
| $V_p$ | filling volume of hydraulic pump 25 |
| $x_o$ | amplitude of oscillation of dynamic stabilization unit 12 |
| kN | kilonewton |

The following equations will assist in giving the theoretical basis for determining the resistance of the track to transverse displacement (QVW):

For the friction power ($P_r$) transmitted to track 5:

$$P_r = \frac{dW}{dt} = F \cdot v = F_v \cdot \mu \cdot x_0 \cdot 2\pi f \cdot \cos(2\pi f t) = F_v \cdot \mu \cdot x_0 \cdot 2\pi f \cdot \frac{2}{\pi} = F_v \cdot \mu \cdot x_0 \cdot 4f = QVW \cdot x_0 \cdot 4f$$

For the power input ($P_{zu}$):

$$P_{zu}=Q_p \cdot P_p=V_p \cdot n_p \cdot P_p=V_p \cdot f \cdot P_p$$

For the constant power output ($P_{ab}$):

$$P_{ab}=P_{DGS}+P_g+P_{rot}$$

The QVW correlation is derived from the following power balance:

$$P_{zu}=V_p \cdot f \cdot P_p=P_r+P_{ab}=QVW \cdot x_0 \cdot 4f+P_{ab}$$

If a standardized value $QVW_{100}$ is to be obtained, for example, for a vertical load of 100 kN, the influence of the varying vertical load applied to track 5 to settle the track during the operation of the dynamic stabilization unit must be eliminated. The adjustment of hydraulic pump 25 is not changed to maintain a constant piston displacement. (Alternatively, the piston displacement could be varied but this would require taking this variation into account in measuring the power.)

$$QVW_{100} = \frac{V_p \cdot P_p}{4 \cdot x_0} \cdot \frac{F_v}{100} - \frac{P_{ab}}{4 \cdot x_0 \cdot f} \cdot \frac{F_v}{100} = k_v \cdot \frac{F_v \cdot P_p}{x_0} - k_0 \cdot \frac{F_v}{x_0 \cdot f}$$

For constant values of the amplitude $x_o$ of oscillations, the frequency f of oscillations and static load $F_v$, the equation is:

$$QVW_{100}=k_v \cdot P_p-k_0$$

As can be seen from the above equations, it is possible in principle to measure even the absolute value of QVW. At any rate, the qualitative behavior of the resistance of the track to transverse displacement (QVW) can be measured during the dynamic stabilization of the track and its settling at a desired level.

The QVW measurement may be effected during the controlled settling of track 5 by dynamic stabilizer units 12 monitored by reference system 16 to obtained the desired track level or it could be effected in a subsequent measuring step in which machine 1 is driven along the previously stabilized track 5 while a minimal vertical load is applied so that the track is not lowered but merely subjected to transverse oscillations in a horizontal plane.

It is possible to replace the described hydraulic power system by equivalent energy systems, for example electrical power operating oscillation generator 21. In that case, the current changes would be the correlated measurement value of the transverse track displacement resistance (QVW).

What is claimed is:

1. A method of continuously measuring the resistance of a track to transverse displacement, which comprises the steps of (a) continuously advancing a vibrating means along the track while the vibrating means grips the track, (b) applying hydraulic pressure to the vibrating means to impart oscillations to the track extending transversely to the track in a horizontal plane while keeping other factors influencing the oscillation power constant, and (c) recording a datum corresponding to the hydraulic pressure as a correlated measurement value of the transverse track displacement resistance (QVW).

2. The method of claim 1, comprising the further step of recording at least one additional datum selected from the group consisting of the frequency (f) of the oscillations, the amplitude ($x_o$) of the oscillations, a vertical load ($F_v$) applied to the vibrating means, and the speed of advancement of the vibrating means along the track as another corelated measurement value of the transverse track displacement resistance.

3. A measuring apparatus for continuously measuring the resistance of a track to transverse displacement, the track comprising two rails, which comprises (a) a machine frame adapted to advance continuously along the track, (b) a vibrating means mounted on the machine frame and including (1) adjustable tools for selectively gripping the track rails for frictional engagement therewith, (c) a generator of oscillations connected to the vibrating means for imparting to the track gripped by the adjustable tools, oscillations extending transversely to the track in a horizontal plane while keeping other factors influencing the oscillation power constant, the generator including (1) a hydraulic power system comprising a hydraulic pump delivering an operating hydraulic pressure, and (d) a pressure indicator recording a datum corresponding to the hydraulic pressure power delivered to the vibrating means as a correlated measurement value of the transverse track displacement resistance.

4. The measuring appratus of claim 3, further comprising vertically adjustable hydraulic drive means for applying a vertical load to the track, the drive means connecting the vibrating means to the machine frame, and a further pressure indicator recording a datum corresponding to the hydraulic pressure power applying the vertical load.

5. The measuring apparatus of claim 3, further comprising a measuring device recording a datum corresponding to the amplitude of oscillations.

6. The mesuring apparatus of claim 5, wherein the measuring device is an acceleration indicator.

7. A dynamic track stabilizer for settling a track comprising two rails at a desired level and for continuously measuring the resistance of the track to transverse displacement, which comprises (a) a machine frame adapted to advance continuously along the track on undercarriages supporting the machine frame on the track, (b) a track stabilizing unit including (1) adjustable tools for selectively gripping the track rails for frictional engagement and (2) a generator of oscillations for imparting to the track gripped by the adjustable tools oscillations extending transversely to the track in a horizontal plane while keeling other factors influencing the oscillation power constant, the generator including a hydraulic pump delivering an operating hydraulic pressure, (c) a vertically adjustable drive means connecting the track stabilizing unit to the machine frame, (d) a track level reference system on the machine frame for establishing the desired track level, (e) a pressure indicator recording a datum corresponding to the hydraulic pressure delivered by the hydraulic pump, and (f) a recording device for recording the datum as a correlated measurement value of the transverse track displacement resistance.

8. A method of continuously measuring the resistance of a track to transverse displacement, which comprises the steps of (a) continuously advancing a vibrating means along the track while the vibrating means grips the track, (b) applying a hydraulic pressure ($p_p$) to the vibrating means to impart oscillations to the track extending transversely to the track in a horizontal plane, (c) recording a datum corresponding to the hydraulic pressure ($p_p$) applied to the vibrating means as a correlated measurement value of the transverse track displacement resistance (QVW), recording the following additional data: the frequency (f) of the oscillations, the amplitude ($x_o$) of the oscillations, a vertical load ($F_v$) applied to the vibrating means, and the speed of advancement of the vibrating means along the track as other correlated measurement values of the transverse track displacement resistance, (d) feeding the data corresponding to the hydraulic pressure ($p_p$), the frequency (f) of the oscillations, the amplitude ($x_o$) of the oscillations, and the vertical load ($F_v$) applied to the vibrating means to a computer and, (e) correlating the data in the computer according to the equation $$QVW = k_v \cdot \frac{F_v \cdot P_p}{x_0} - k_0 \cdot \frac{F_v}{x_0 \cdot f}$$

9. The method of claim 8, comprising the further step of standardizing the transverse track displacement resistance under the assumption of a constant measuring value for the amplitude and frequency of the oscillations for a constant vertical load ($F_v$/100).

* * * * *